US005102371A

United States Patent [19]

Hanauer

[11] Patent Number: 5,102,371

[45] Date of Patent: Apr. 7, 1992

[54] REVERSIBLE BUSINESS FORMS

[75] Inventor: Lisa A. Hanauer, Centerville, Ohio

[73] Assignee: Med-Pass, Incorporated, Dayton, Ohio

[21] Appl. No.: 705,129

[22] Filed: May 24, 1991

[51] Int. Cl.[5] ..... B42D 1/00

[52] U.S. Cl. ..... 462/56; 462/66; 281/2

[58] Field of Search ..... 462/56, 55, 66, 67, 462/8; 281/2, 41, 38

[56] References Cited

U.S. PATENT DOCUMENTS 867,316 10/1907 Sperry ..... 462/56

*Primary Examiner*—Timothy V. Eley
*Assistant Examiner*—Willmon Fridie
*Attorney, Agent, or Firm*—Biebel & French

[57] ABSTRACT

Business forms have marginal areas for loose-leaf binding either at the side or at the top. Instructional information is printed on a front face of a sheet of the form in a normal orientation reading from top to bottom. Instructional information for the rear face is printed twice, once in an orientation reading from top to bottom and again in an orientation reading from bottom to top. This presents a user with upright instructions on the rear face of the form regardless of the type of binding employed.

5 Claims, 8 Drawing Sheets

REVERSIBLE BUSINESS FORMS

BACKGROUND OF THE INVENTION

The present invention relates to preprinted business forms organized for entry of data on both front and rear faces thereof. The invention has particular utility in the field of business forms designed for entry of data by hand. Such hand entry of data is common, for instance, in the health care industry where nurses and other professionals make frequent handwritten entries in a large number of identical forms or charts associated with different patients.

In those applications involving frequent handwritten entries in large numbers of similar forms, it is convenient to carry the forms in a loose-leaf binder. Such binders are of two general types; those which have rings at the sides and those which have rings at the top. When such business forms are bound at the side, the data entry instructions must be oriented for reading from top to bottom on both the front and rear faces of the forms. However, when the forms are bound at the top the consequent bottom opening of the binder produces a reversal of the rear faces. Therefore, business forms which are designed for binding at the top must have their front faces printed for reading from top to bottom and their rear faces printed for reading from bottom to top. Thus it has been a past practice of forms printers and forms users to stock duplicate sets of forms in order to accommodate use in the two different types of binders. Such duplicate stocking is inefficient and expensive.

SUMMARY OF THE INVENTION

In accordance with the present invention, a first field of instructional information and a second field of instructional information are preprinted on a business form. The first field of instructional information is preprinted on the front face and reads from top to bottom. The second field of instructional information is preprinted on the rear face of the form at two different regional locations. In a first region the information is printed in an orientation for reading from top to bottom while in a second region it is printed in an orientation for reading from bottom to top. The form is provided with a marginal binding area at one side and also at the top. Both marginal areas may be provided with binding apertures so as to enable use of the form in a binder having binding rings located at the side or in a binder having binding rings located at the top. In either event, a user who opens the binder and turns a form for rear face entry of data sees a copy of the second field of instructional information in the proper orientation for reading.

It is therefore an object of this invention to provide improved reversible business forms.

It is another object of the invention to provide business forms having instructions on a rear face thereof which may be viewed in an upright orientation when bound either at the side or at the top.

It is a still further object of the invention to provide a business form set having a common sheet that is co-extensive with a first and second preceding sheet wherein information zones of the first and second preceding sheets are selectively transmitted onto the common sheet. The above business forms may be further assembled in a manifold having first and second preceding sheets associated with a third or common sheet as described above. A patterned carbon sheet having a carbon coating facing the common sheet in a pattern which is co-extensive with a zone of transferable data is positioned between the common sheet and the second preceding sheet.

There and other objects and advantages of the invention will be apparent from the following description, the accompanying drawings and the appended claims.

DESCRIPTION OF PREFERRED EMBODIMENTS

A business form in accordance with the present invention may be configured for reception of any type of business information. A typical business form 10 for recording of medical information may have a front face 12 as illustrated in FIG. 1 and a reversely opposite rear face 14 as illustrated in FIG. 2.

Figure 1:
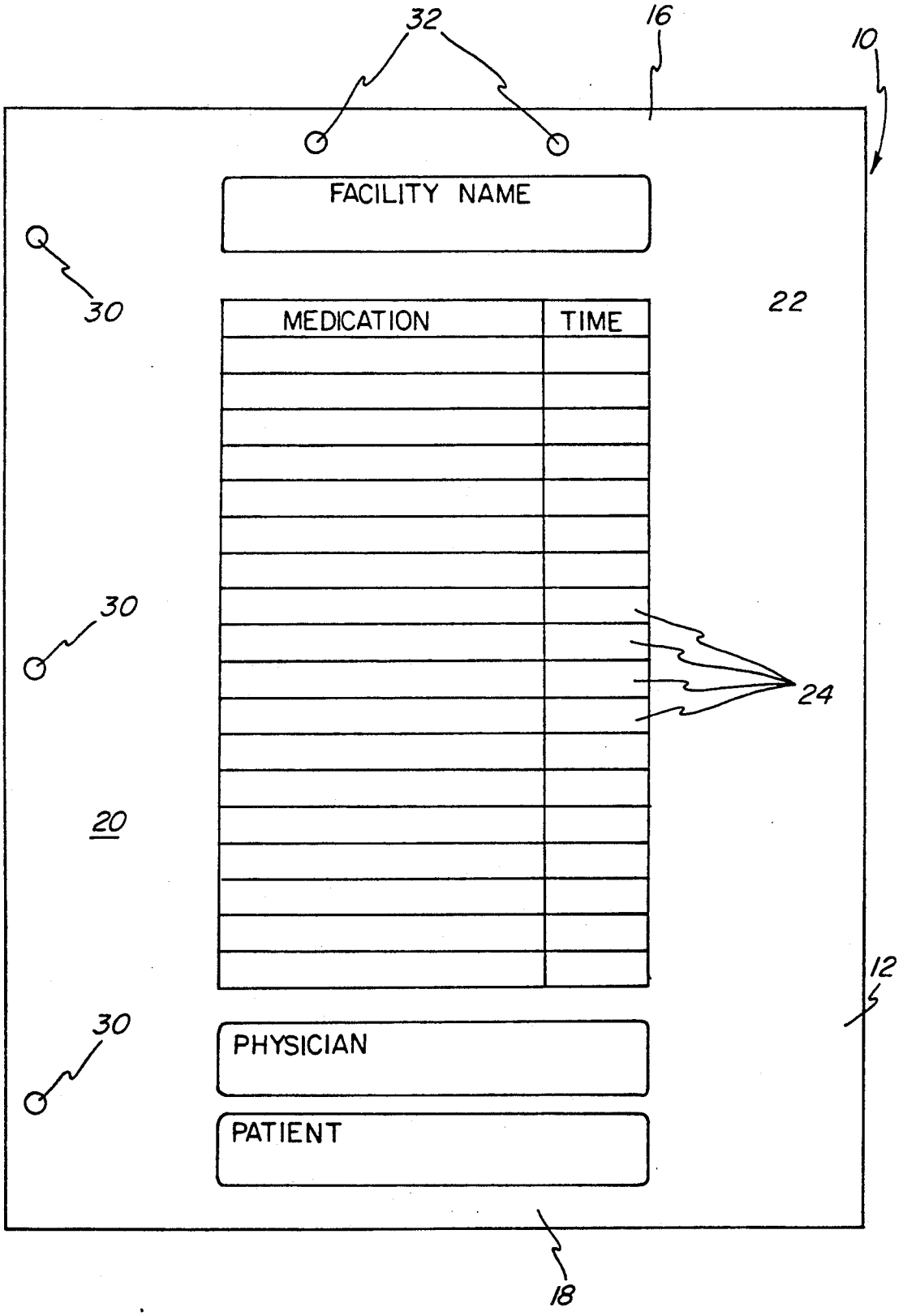
FIG. 1 is a schematic illustration of the front face of a business form.
Figure 2:
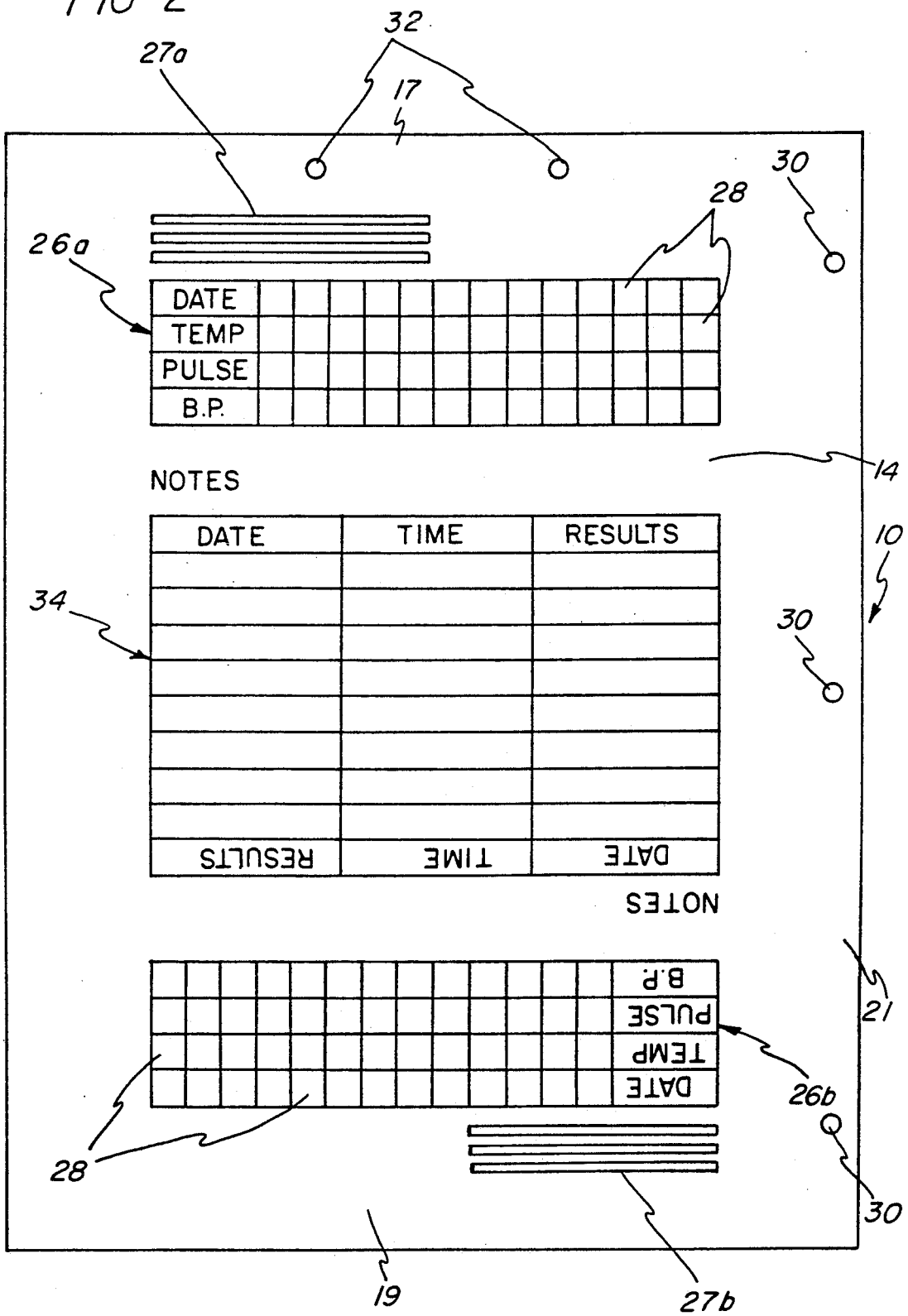
FIG. 2 is a schematic illustration of the rear face of a business form.

Referring now to FIG. 1, front face 12 has a top margin 16 located at its top end and an adjacent side margin 20 extending from top to bottom. Top margin 16 provides a gripping area for binding business form 10 at the top, while side margin 20 provides a gripping area for binding the form at one side. Matching marginal areas are provided on rear face 14.

The front face 12 is imprinted with a first field of instructional information 22 which is organized to provide a series of spaces 24 for entry of first items of data. The first items of data may consist of information such as facility name, medication administered, time of administering, physician's name, and patient's name, as generally illustrated in FIG. 1. It will be appreciated that first field of instructional information 22 may contain detailed instructions relating to entry of the above-noted first items of data. For ease of illustration, FIG. 1 shows only instructional information identifying the names of the items of data to be entered. First field of instructional information 22 is oriented for reading from top to bottom.

Figure 3:
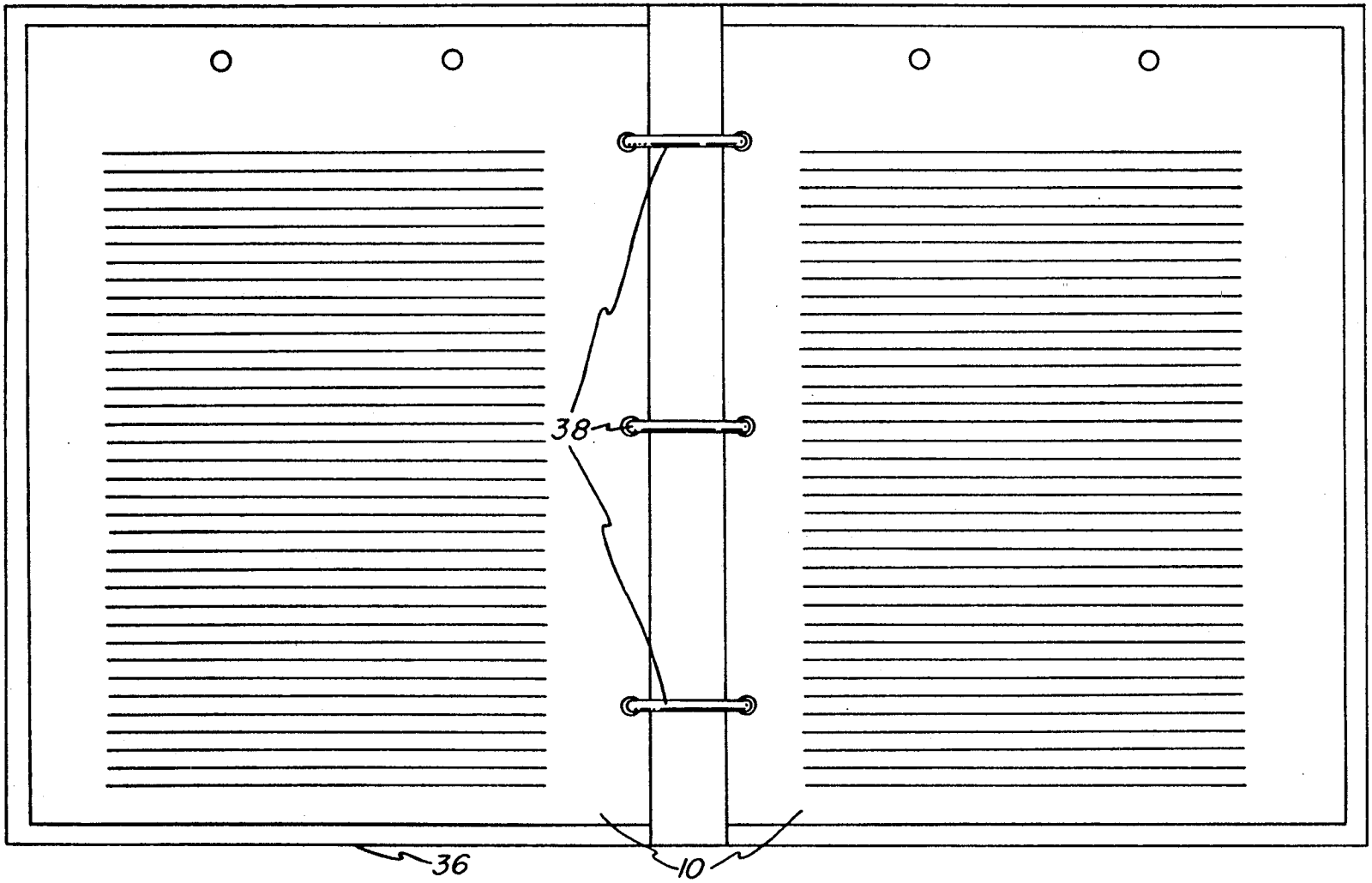
FIG. 3 is an illustration of business forms according to this invention bound at the side in a looseleaf binder.

Business form 10 preferably has a first set of binding apertures 30 situated in side margin 20 for reception of binding rings 38 of a three-ring binder 36 as illustrated in FIG. 3. When a plurality of forms 10 are bound for sideways accessibility as illustrated in FIG. 3, the instructional information relating to entry of data items on the rear faces thereof must be oriented for reading from top to bottom. This is explained in greater detail below.

Binding rings 38 may be conventional snap rings, as illustrated, but binder 36 may employ any other convenient mechanism capable of gripping business form 10 within side margin 20. Accordingly the number of binding rings 38 is not critical. In an alternative embodiment, not illustrated, business form 10 has a vertically extending perforation line defining the right-hand side of side margin 20. This affords the user the option of detaching side margin 20 in applications where side binding is not required.

Figure 4:
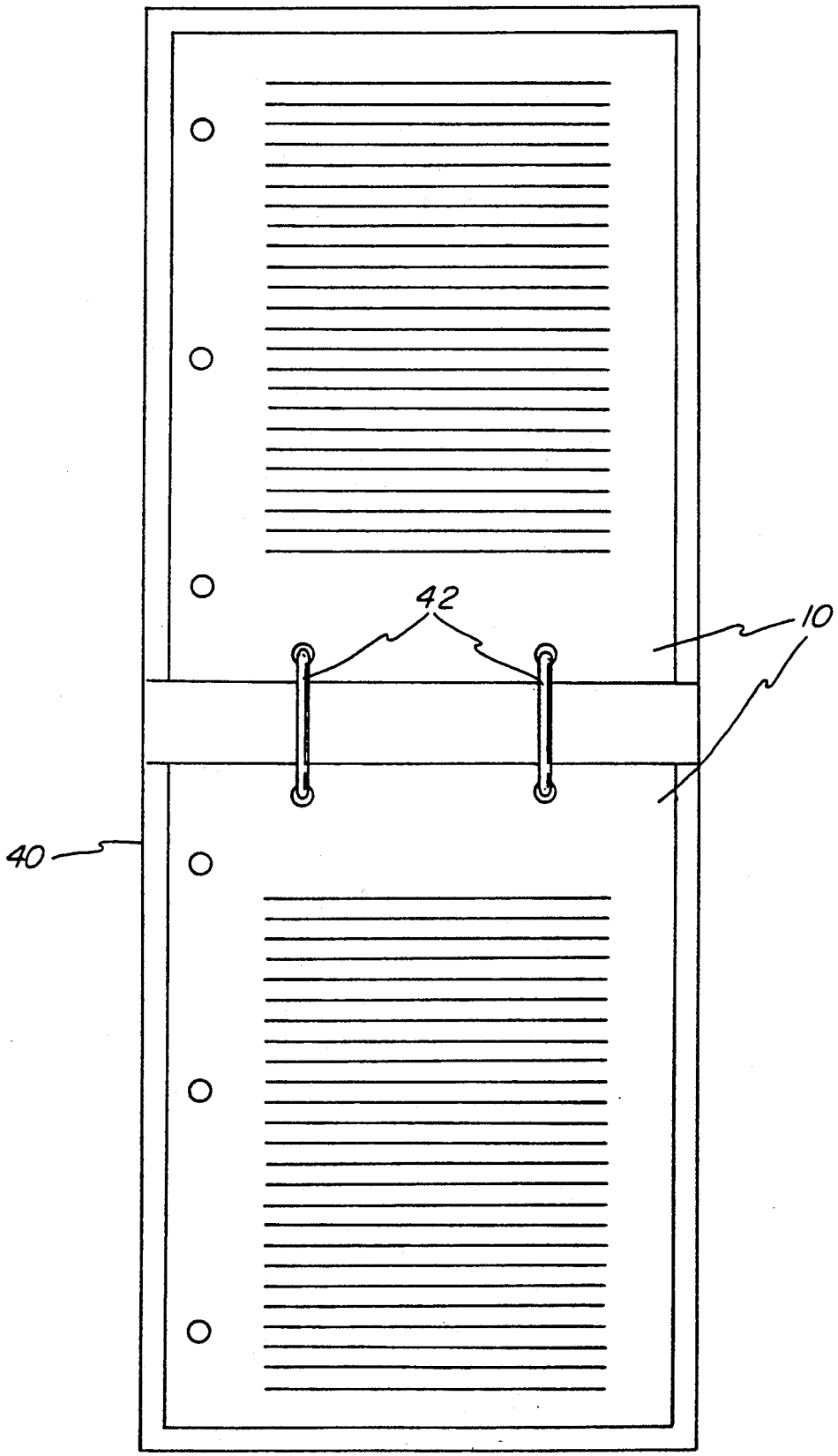
FIG. 4 is an illustration of business forms according to this invention bound at the top in a looseleaf binder.

Whether business form 10 has a permanent or a detachable side margin, provision may be made for a second set of binding apertures 32 in top margin 16. This provides business form 10 with the flexibility of being able to accommodate use in a top-end binder 40 as illustrated in FIG. 4. Binder 40 has two swivel type binding rings 42 for insertion through apertures 32. Again, the number of apertures and the number of binding rings is unimportant.

It is apparent that the bottom opening feature of binder 40 causes the rear faces of any forms 10 bound therein to be presented to the user in an upside-down orientation. In order to obviate the need for end-to-end turning of binder 40 the rear face 14 of business form 10 is printed as illustrated in FIG. 2. Thus a second field of instructional information 26 is printed twice on the rear face 14 of business form 10. These prints are made within first and second printing regions 26*a* and 26*b* which are proximate the top and bottom ends respectively of rear face 14.

Within the first printing region 26*a* the second field of instructional information is printed in a top-to-bottom orientation to facilitate instruction reading and data entry while being gripped at the side as illustrated in FIG. 3. However, the printing in the second region as shown at 26*b* reads from bottom to top for easy data entry in a bottom opening binder as shown in FIG. 4.

Figure 2A:
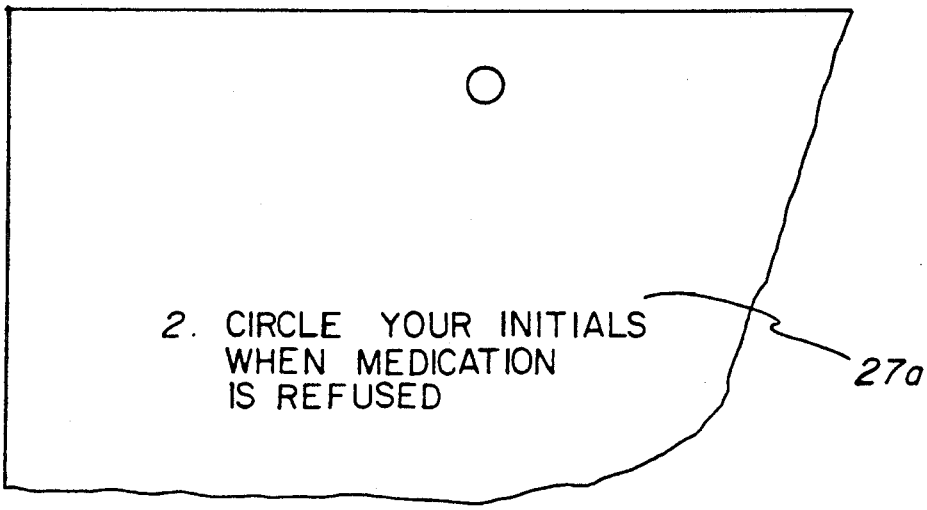
FIG. 2A is an enlarged illustration of a portion of FIG. 2.
Figure 2B:
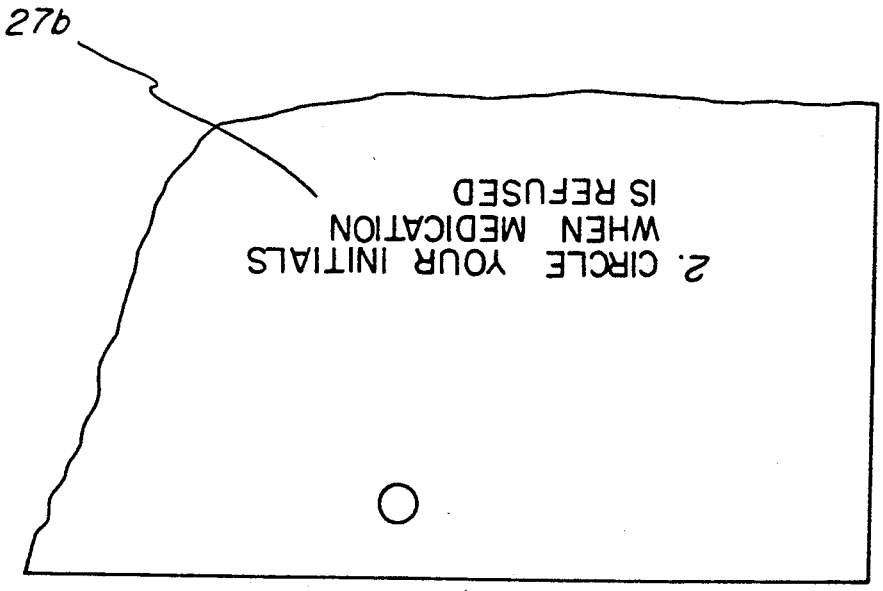
FIG. 2B is an enlarged illustration of another portion of FIG. 2.

The second field of instructional information may include detailed instructions for the user as well as identification names for data to be entered. While full reproduction of a typical set of instructions is not practical herein, a portion of such instructions may appear as identified by reference numerals 27*a* and 27*b* in FIGS. 2A and 2B. Second field of instructional information 26 additionally includes spaces 28 for entry of second items of data, which for illustrative purposes, may comprise information such as date, temperature, pulse rate and blood pressure. These data items may be written in a top-to-bottom orientation in region 26*a* or in a bottom-to-top orientation in region 26*b*.

In the preferred embodiment, as illustrated in FIG. 2, rear face 14 also has a central region of preprinted data blocks 34 with reversed headings at the top and bottom thereof. The block 34 is lined to define columns of equal width, so that data entry is the same whether made from top to bottom or bottom to top.

Figure 6:
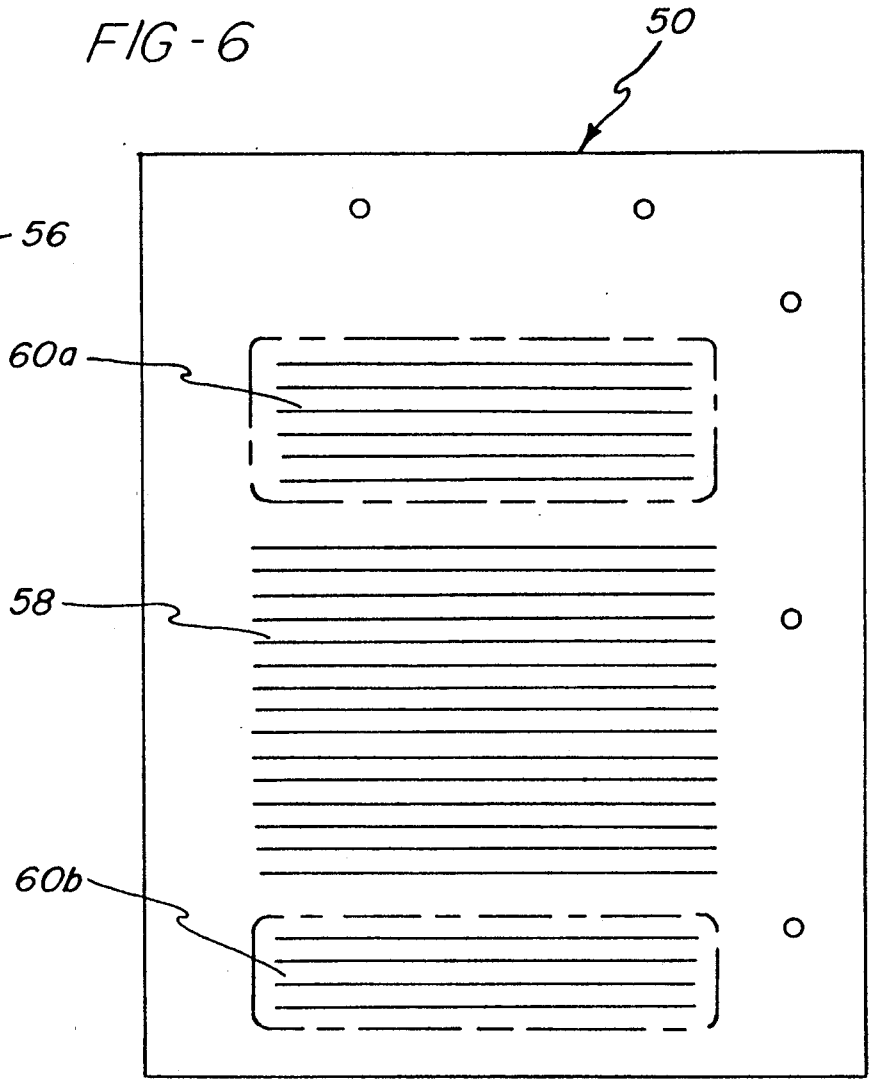
FIG. 6 is an illustration of the rear face of the business form of FIG. 5.
Figure 5:
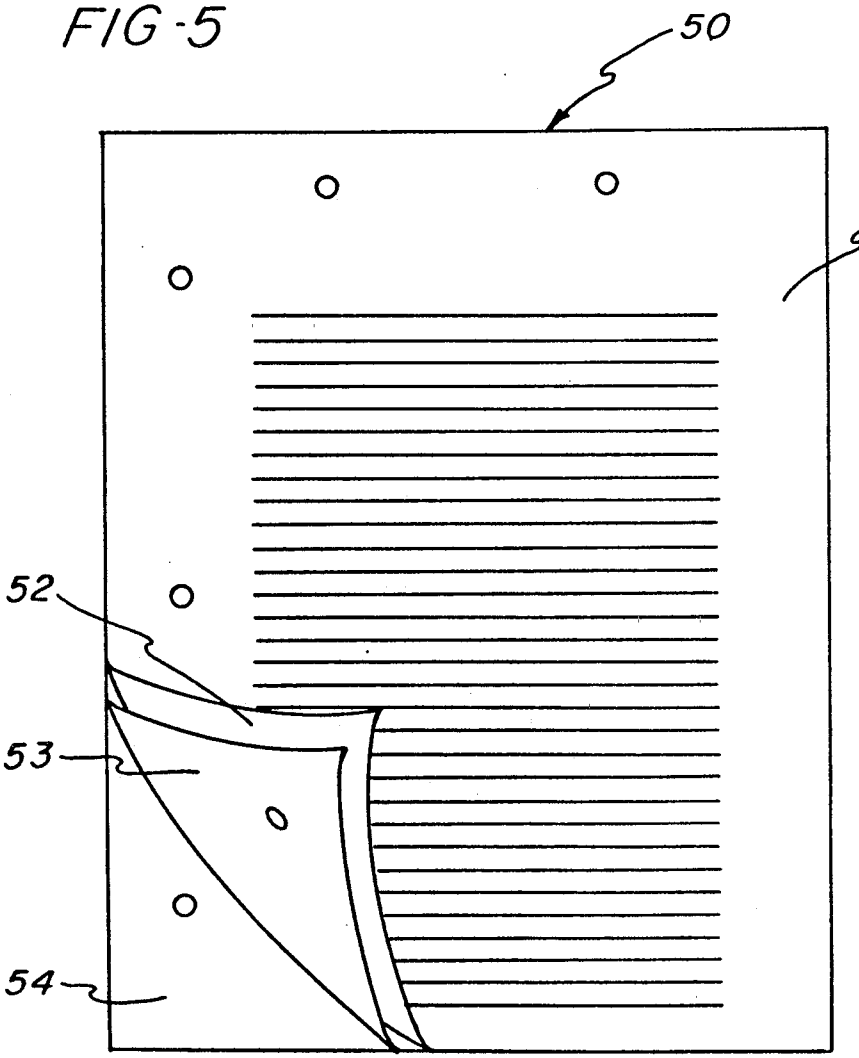
FIG. 5 is an illustration of the front face of a business form in an alternative embodiment.

The above-described invention may be implemented in a single sheet business form 10 or in a manifold arrangement 50, as illustrated in FIGS. 5 and 6. Manifold 50 may comprise a first sheet 52, a second sheet 54, and other sheets as desired (not illustrated). Sheets 52 and 54 may be joined at one or more edges and may have a carbon sheet 53 positioned therebetween. Alternatively, other pressure sensitive mark transfer material may be employed in combination with or in place of carbon sheet 53. For example the contacting surfaces of sheets 52 and 54 may be coated with microencapsulated reactive marking dyes for production of "carbonless copy".

Front face 56 of business form 50 is a physical part of sheet 52, whereas rear face 58 of business form 50 is a physical part of sheet 54. Rear face 58 carries a second field of instructional information which is printed in a first region 60*a* from top to bottom and in a second region 60*b* from bottom to top. Form 50 has binding apertures at the top and side marginal areas in like manner as business form 10.

Figure 7:
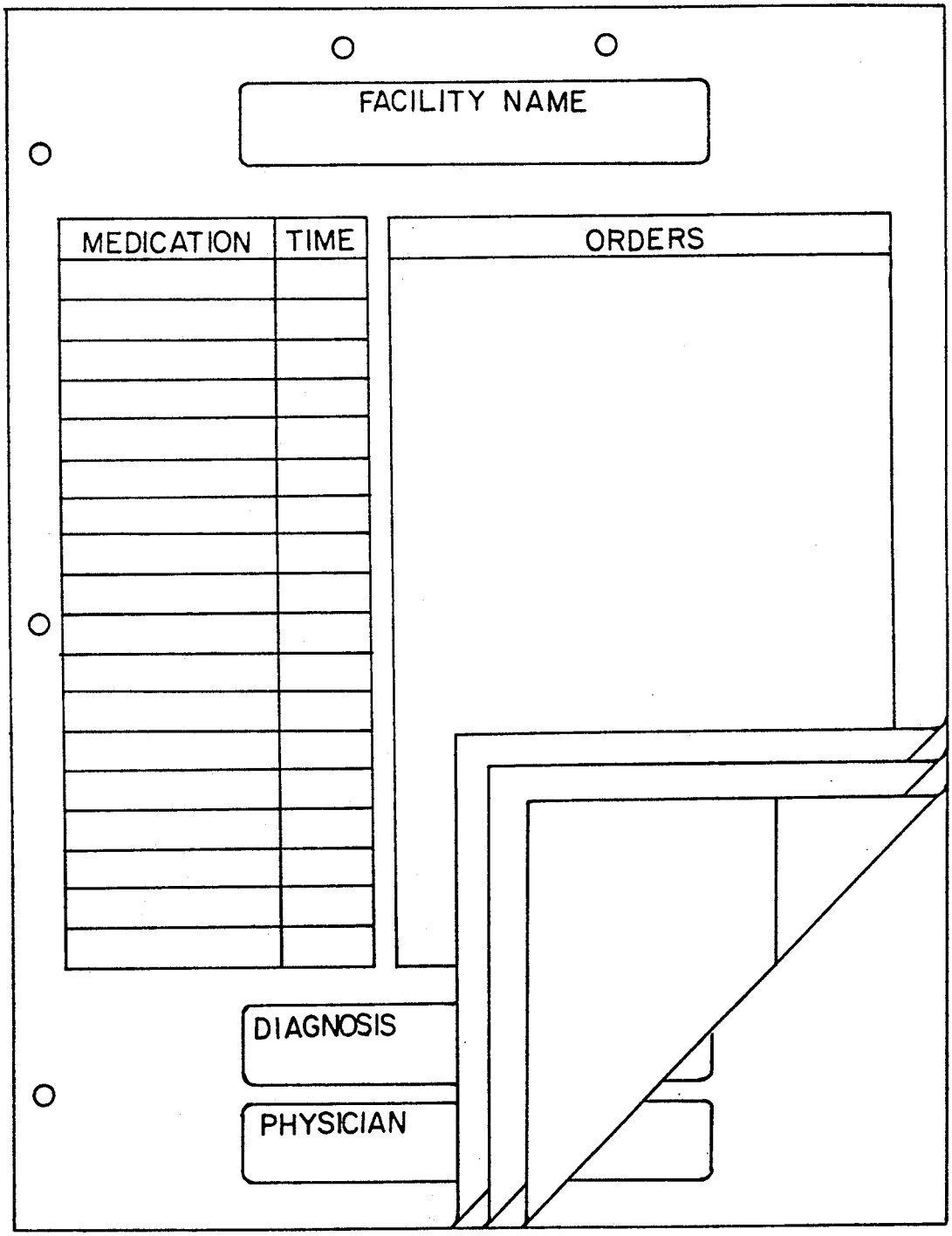
FIG. 7 is an illustration of a further embodiment of the business form of this invention.
Figure 8:
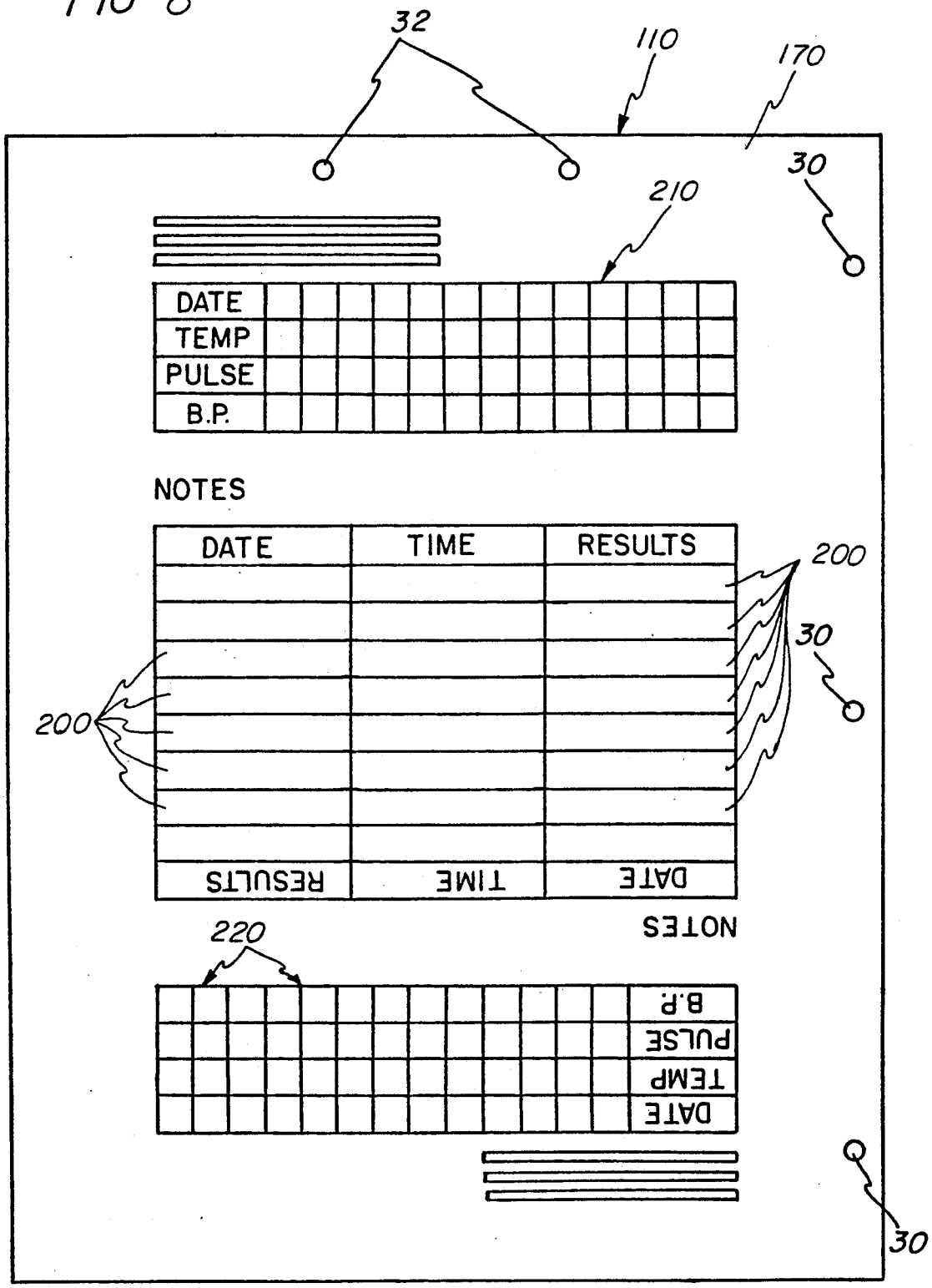
FIG. 8 is an illustration of the rear face of the form of FIG. 7.

In a further embodiment show in FIGS. 7 and 8, a manifold business formset 10 has first and second preceding sheets associated with a third or common sheet 110 configured as described above. The first preceding sheet 120 is coextensive with the common sheet 110 and positioned in front of the common sheet's face. The second preceding sheet 130 is also coextensive with the common sheet and positioned between the common sheet and the first preceding sheet. A patterned carbon sheet 140 is positioned between the common sheet 110 and the second preceding sheet 130. The patterned carbon sheet 140 has a carbon coating facing the common sheet in a pattern which is coextensive with the second information zone 150 on the face 160 of the common sheet 110.

A typical common sheet 110 of a business form set 100 according to this invention for recording of medical information has a front face 160, and a rear face 170 (FIG. 8), configured similarly to that shown in FIGS. 1 and 2. The front and rear faces serve as reversely opposite faces wherein the front face 160 comprises a first information zone 165 and a second information zone 150 and a first field of instruction information 180. As discussed above the first field of instructional information may contain detailed instructions relating to entry of facility name, physician's name and patient's name which is organized to provide a series of spaces 200 for entry of first items of data.

As described in connection with FIG. 2, the rear face 170 of the common sheet 110 (FIG. 8) includes first and second printing regions 210 and 220 which are proximate the top and bottom ends respectively of rear face 170. Within the first printing region 210 the second field of instructional information is printed in a top-to-bottom orientation to facilitate instruction reading and data entry on a side opening binding as shown in FIG. 3, while the printing in the second region as shown at 220 reads from bottom to top for easy data entry in a bottom opening binder as shown in FIG. 4. As stated above, the second field of instructional information may include detailed instructions for the user, identification names for data to be entered and spaces 200 for entry of second items of data.

Further the rear face 170 also has a central region or preprinted data region 230 with reversed headings at the top and bottom thereof. The region 230 is lined to define columns of equal width so that data entry is the same whether made from top to bottom or bottom to top.

The front faces of the first and second preceding sheets are substantially similar to the front face of the first sheet of the previous two embodiments except that the mutual contacting surface 240 of the first and second preceding sheets have their contacting faces coated with pressure sensitive microencapsulated reactive colorants. The coating ensures that markings made on the front face of the first preceding sheet are copied onto the front face of the second preceding sheet and also onto the common sheet when markings are made in the second information zone 150. However, because the patterned carbon sheet 140 is carbon coated in a pattern which is coextensive with the second information zone 150, the markings are copied in a first information zone of the second preceding sheet 130 and not the common sheet 110.

The common sheet 110 may be detached and used separately from the business form set 100 thereby resulting in a substantially similar form to the first embodiment of the invention.

While the products herein described constitute preferred embodiments of the invention, it is to be understood that the invention is not limited to these precise products, and that changes may be made therein without departing from the scope of the invention which is defined in the appended claims.

What is claimed is:

1. A business form comprising:

a front face having opposed top and bottom boundaries;

a first field of instructional information printed on said front face and including lines defining spaces for entry of first items of that data and printed words reading in a top-to-bottom direction;

a rear face reversely opposite said front face and having common top and bottom boundaries therewith;

a second field of instructional information printed in a first region on said rear face in an orientation for reading in the direction from top to bottom and also printed in a second region on said rear face in an orientation for reading in the direction from bottom to top, said second field of instructional information being printed in a manner defining spaces for entry of second items of data;

a side margin for side binding such that said form may be reversed by sideward movement whereby reading of said second field of instructional information and entry of said second items of data may proceed in a top to bottom direction within said first region; and a top margin for top binding to enable upward reversal of said form, so that reading of said second field of instructional information and entry of said second items of data may proceed in a bottom to top direction within said second region.

2. A business form comprising:

a front face having opposed top and bottom boundaries;

a first field of instructional information printed on said front face and including lines defining spaces for entry of first items of data and printed words reading in a top-to-bottom direction;

a rear face reversely opposite said front face and having common top and bottom boundaries therewith;

a second field of instructional information printed in a first region on said rear face in an orientation for reading in the direction from top to bottom and also printed in a second region on said rear face in an orientation for reading in the direction from bottom to top, said second field of instructional information being printed in a manner defining spaces for entry of second items of data;

a side margin provided with a first set of binding apertures for side binding to enable sideways reversal of said form, so that reading of said second field of instructional information and entry of said second items of data may proceed in a top to bottom direction within said first region; and a top margin provided with a second set of binding apertures for top binding to enable upward reversal of said form, so that reading of said second field of instructional information and entry of said second items of data may proceed in a bottom to top direction within said second region.

3. A business form according to claim 2 wherein said first region is proximate top end of said rear face and said second region is proximate the bottom end of said rear face; said business form further comprising a central region of preprinted data blocks located on said rear face between said first and second regions for receiving data items alternatively oriented either top to bottom or bottom to top.

4. A business form according to claim 2 comprising a plurality of sheets joined together at their edges and having pressure sensitive mark transfer material therebetween; said front and rear faces being on different sheets.

5. A business form according to claim 1 wherein said front face and said rear face are opposite faces of a common sheet and said front face comprises a first information zone and a second information zone, said first field of instructional information being printed within said first information zone; said business form further comprising:

a first preceding sheet coextensive with said common sheet and positioned in front of said front face;

a second preceding sheet co-extensive with said common sheet and positioned between said common sheet and said first preceding sheet, and a patterned carbon sheet positioned between said common sheet and said second preceding sheet, said carbon sheet having a carbon coating facing said common sheet in a pattern which is coextensive with said second information zone;

said first and second preceding sheets being in face-to-back contact and having their contacting surfaces coated with pressure sensitive microencapsulated reading colorants so that marks on the front face of said first preceding sheet are copied onto said second preceding sheet and also onto said common sheet when written into said second information zone, but are copied only onto said second preceding sheet when written into said first information zone.

* * * * *

UNITED STATES PATENT AND TRADEMARK OFFICE

CERTIFICATE OF CORRECTION

PATENT NO. : 5,102,371

DATED : April 7, 1992

INVENTOR(S) : Lisa E. Hanauer

It is certified that error appears in the above-identified patent and that said Letters Patent is hereby corrected as shown below:

On the title page:
Item 75 should read "Lisa E. Hanauer"

Signed and Sealed this

Thirty-first Day of August, 1993

Bruce Lehman

*Attest:*

BRUCE LEHMAN

*Attesting Officer*

*Commissioner of Patents and Trademarks*